US009291422B1

(12) United States Patent
Gold et al.

(10) Patent No.: US 9,291,422 B1
(45) Date of Patent: Mar. 22, 2016

(54) CABLE GUARD APPARATUS AND METHOD

(71) Applicant: Hoyt Archery, Inc., Salt Lake City, UT (US)

(72) Inventors: Brian Gold, Stansbury Park, UT (US); Dan'l J. Anselmo, South Jordan, UT (US); Gideon S. Jolley, Syracuse, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 0 days.

(21) Appl. No.: 14/506,259

(22) Filed: Oct. 3, 2014

(51) Int. Cl.
*F41B 5/14* (2006.01)
*F41B 5/10* (2006.01)

(52) U.S. Cl.
CPC ... *F41B 5/14* (2013.01); *F41B 5/10* (2013.01); *F41B 5/1403* (2013.01)

(58) Field of Classification Search
CPC ..... F41B 5/10; F41B 5/14; F41B 5/1403
USPC ..... 124/25.6, 86, 88
See application file for complete search history.

(56) References Cited

U.S. PATENT DOCUMENTS 4,452,222 A * 6/1984 Quartino ..... F41B 5/10 124/23.1
4,917,070 A * 4/1990 Townsend ..... F41B 5/10 124/23.1
5,392,757 A * 2/1995 Head ..... F41B 5/14 124/25.6
5,791,324 A * 8/1998 Johnson ..... F41B 5/10 124/25.6
5,983,880 A * 11/1999 Saunders ..... F41B 5/10 124/25.6
6,425,385 B1 * 7/2002 Gallops, Jr. ..... F41B 5/10 124/25.6
6,722,354 B1 * 4/2004 Land ..... F41B 5/10 124/25.6
6,904,900 B2 * 6/2005 Gallops, Jr. ..... F41B 5/10 124/25.6
8,028,685 B2 * 10/2011 Clark ..... F41B 5/10 124/25.6
8,307,816 B2 * 11/2012 Darlington ..... F41B 5/10 124/1
8,371,283 B2 * 2/2013 Grace ..... F41B 5/10 124/25.6
8,402,960 B2 * 3/2013 McPherson ..... F41B 5/10 124/25.6

(Continued)

OTHER PUBLICATIONS

RPM 360, Bowtech Catalog, pp. 7-8, 2014.

(Continued)

*Primary Examiner* — Alexander Niconovich
(74) *Attorney, Agent, or Firm* — Holland & Hart

(57) ABSTRACT

A compound archery bow having a reverse-pivot cable guard, wherein the cable guard has a first cantilever member connected to a riser at a proximal end and extending away from the riser at a distal end and a second cantilever member attached to the distal end of the first cantilever member and extending back toward the riser. The proximal end of the second cantilever member retains a bow cable such that when the bow is drawn, the second cantilever member flexes toward the plane of arrow flight and the bowstring and away from the riser. This design may reduce stresses on the cable guard, reverse torque on the riser, and improve cable life, among other benefits.

25 Claims, 9 Drawing Sheets

(56) References Cited

U.S. PATENT DOCUMENTS 8,424,511 B2 * 4/2013 Grace, Jr. ..... F41B 5/10 124/25.6
8,485,169 B2 * 7/2013 Dahl, II ..... F41B 5/10 124/25.6
8,616,189 B2 * 12/2013 McPherson ..... F41B 5/10 124/23.1
8,651,097 B2 * 2/2014 Grace, Jr. ..... F41B 5/10 124/25.6
8,746,219 B2 * 6/2014 Anselmo ..... F41B 5/10 124/25.6
8,784,628 B2 * 7/2014 Grace, Jr. ..... F41B 5/10 124/25.6
8,950,388 B2 * 2/2015 McPherson ..... F41B 5/1403 124/25.6
9,046,317 B2 * 6/2015 McPherson ..... F41B 5/1426
2010/0282226 A1 * 11/2010 Marzullo ..... F41B 5/14 124/25.6
2011/0247602 A1 * 10/2011 McPherson ..... F41B 5/10 124/25.6
2013/0061838 A1 * 3/2013 Gordon ..... F41B 5/14 124/25.6
2014/0261359 A1 * 9/2014 McPherson ..... F41B 5/1403 124/25.6
2014/0283807 A1 * 9/2014 Prater ..... F41B 5/10 124/25.6
2014/0299116 A1 * 10/2014 Yehle ..... F41B 5/1403 124/25.6
2015/0027425 A1 * 1/2015 Yehle ..... F41B 5/10 124/25.6
2015/0153133 A1 * 6/2015 McPherson ..... F41B 5/1403 124/25.6

OTHER PUBLICATIONS

Pivot Cable Guard System, Bear Archery Product Catalog, 2014.
Reverse Assist, Mathews Product Catalog, 2014.
Pivot Cable Guard System, Prime Product Catalog, 2014.

* cited by examiner

CABLE GUARD APPARATUS AND METHOD

TECHNICAL FIELD

The present disclosure generally relates to apparatus and methods for improving bow cable guards and relates specifically to reverse pivot and reverse flexible cable guards and related methods.

BACKGROUND

Archers such as bow hunters frequently use compound bows to their advantage. Compound bows have significantly more rigid limbs than traditional or recurve bows and employ a mechanical system, typically a set of pulleys and cables, that offers leverage to the archer while drawing the bow and provides greater velocity when launching an arrow. In order to provide these advantages, the pulleys positioned at the outer ends of the limbs of the bow are linked by tensioning cables. The cables wrap around and turn the pulleys as the bowstring is drawn.

The cables between the pulleys of the bow may interfere with the flight of the arrow. When the bowstring is released, the arrow is launched in the direction of the motion of the bowstring. Because the cable portions are forward of the bowstring, the flight path of the arrow is close enough to the cables to otherwise cause the arrow to be deflected by the cables by contact with the fletchings if a cable guard was not positioned to hold the cables away from the path of an arrow.

Some cable guards are partially flexible cantilever bars attached to the riser handle of the bow and extend rearward to the rest positions of the crossing cables of the bow. The cable guard is attached to the cables to hold them to one side of the bow and out of the path of the arrow and the archer's line of sight.

Cable guards are also used to reduce the amount of torque induced on the riser due to the cable loads. However, in this regard they typically have only limited effectiveness. As the cable tensions increase through the draw cycle, an increasing lateral force is applied to the cable guard due to the cable guard holding the cables laterally away from the flight path of the arrow. This causes the cable guard cantilever to laterally bend, so the free end of the guard is slightly drawn toward the riser. Simultaneously, the limbs of the bow bend inward, causing the pulleys and cables to move rearward with respect to the riser. Therefore, although the cable guard attempts to bend toward the riser, the cables also attempt to draw the cable guard toward the archer. These opposing forces limit the range of motion of the cables and guard. At some point, the rearward component of the tension in the cable overpowers the forward component of the bending of the cantilever cable guard, and the guard is prevented from further bending. This limits the lateral travel and function of the flexible member and adds tension to the cables and applies a moment to the bow that can cause unintended riser flex which negatively impacts accuracy of the bow system.

Other guards use a slide mechanism that moves axially along the cable guard. This is intended to allow the cables to translate easily along the longitudinal direction of the cable guard. But the slide introduces inefficiencies as well, such as increasing the number of moving parts of the guard, causing friction between the slide and the guard holding the slide, and causing an increased moment that twists the bow as it is drawn and released. Usually, a slide mechanism also prevents a beneficial longitudinal force, since the slide must move longitudinally along the length of the guard. The increased tension in the cables coupled with increased longitudinal lever arm distance at full draw cause a larger unfavorable moment on the bow system.

Simply holding the cables to one side of the bow keeps them out of the flight path of the arrow, but also undesirably introduces friction and vibration in the operation of the bow that can cause unnecessary noise and wear on the cable. Thus, some cable guards retain the cables against rollers. The rollers allow the cables to slide along the guard with less friction and vibration while the bow is drawn and released while still keeping the cables out of the path of the arrow. However, because the guard bends as the cables increase tension, the cables often put a significant side load on the wheel bearing assemblies and reduce their effectiveness. Therefore improvements are desired in archery cable guards.

SUMMARY

One aspect of the present disclosure relates to a compound archery bow having a reverse-pivot or reverse-bending cable guard. The bow may comprise a handle riser assembly including a riser, upper and lower limbs each including a proximal end connected to the riser and a distal end, and a pulley positioned at the distal end of each of the upper and lower limbs. At least one cable and a bowstring may extend between the pulleys. The bow may further include a cable guard that has a first cantilever member having a proximal end connected to the riser and a distal end, a second cantilever member having a distal end attached to the distal end of the first cantilever member and a proximal end extending toward the riser, and a guide portion at the proximal end of the second cantilever member which receives at least one portion of the at least one cable.

In this bow, the guide portion may comprise at least one roller wheel configured to contact and roll along the at least one cable. The first cantilever member may comprise an opening through which the second cantilever member is positioned. The second cantilever member may be attached to a side of the first cantilever member opposite a direction of deflection of the second cantilever member upon drawing the bow. The distal end of the first cantilever member may be configured to deflect away from the at least one cable upon drawing the bow. The proximal end of the second cantilever member may be configured to deflect away from the riser upon drawing the bow. The first cantilever member may further comprise a support contacting the second cantilever member between the proximal and distal ends of the second cantilever member. A roller axis may extend through the center of rotation of the at least one roller wheel (e.g., as an axis of rotation) and a longitudinal axis may extend along the length of the first cantilever member. An included angle between the roller axis and the longitudinal axis may increase when the bowstring is drawn.

In another aspect of the present disclosure, a flexible guide cable guard for an archery bow is provided that may comprise a base portion configured to mount to a riser of an archery bow, a flexible retaining member attached to the base portion and having a free end extending toward the riser, wherein the free end has at least one cable retaining guide configured to receive a cable of a bow and is configured to deflect away from the riser upon bending relative to the base portion.

In this cable guard, the cable retaining guide may comprise an aperture and/or at least one roller. In one case, the cable retaining roller may comprise at least two cable retaining rollers. These cable retaining rollers may be coaxial. The flexible retaining member may comprise a shaft extending through the at least one cable retaining roller. The flexible retaining member may be removably attached to the base portion. An elastic dampening member may be positioned between the base portion and the flexible retaining member, and the flexible retaining member may extend through an opening in the base member.

In another embodiment, a reverse-biased cable guard for an archery bow is provided. This guard may include a base portion having a proximal end configured to mount to a riser of an archery bow and a distal end extending away from the riser toward a cable of the archery bow. A cable mounting arm may be affixed to the base portion, which cable mounting arm may have at least one cable roller configured to retain the cable of the archery bow. Upon drawing this archery bow, the at least one cable roller may contact the cable of the archery bow, and the distal end of the base portion may be subject to a moment tending to bias the distal end of the base portion away from the cable contacting the at least one cable roller.

With this cable guard, upon drawing the archery bow, the at least one cable roller may be configured to move in a direction of cable loading on the at least one cable roller. The cable mounting arm may be more elastically flexible than the base portion. When drawing the archery bow, the cable mounting arm may be subject to a canceling (i.e., opposing) moment tending to cancel or at least partially oppose the moment that tends to bias the distal end of the base portion. The canceling moment may neutralize the moment tending to bias the distal end of the base portion.

In yet another aspect, a method of positioning an archery bow cable relative to a riser is disclosed. This method may include providing an archery bow having a riser, limbs extending from the riser, a cable extending between free ends of the limbs, and a bowstring extending between the free ends. The method may also include connecting a cable guard support to the riser and connecting a deflection arm to the cable guard support at a connection point. The at least one cable roller in this case may be positioned longitudinally between the connection point and the riser, and the cable may engage the at least one cable roller.

The method may further comprise bending the deflection arm away from the cable guard support by forces resulting from drawing the bowstring, and/or dampening the deflection arm using a dampening member positioned between the deflection arm and the cable guard support.

In some embodiments, bending the deflection arm away from the cable guard support may bend the deflection arm away from the riser. The method may also include inducing a moment in the cable guard support tending to drive a free end of the cable guard support away from the cable. In some cases, connecting the deflection arm to the cable guard support may include inserting the deflection arm through the cable guard support.

In another aspect, a cable guard may comprise a cable guard body configured to attach to a handle riser of the archery bow at a proximal end portion and configured to secure a cable of the archery bow at a terminal end portion. The cantilever member may have a distal end portion extending distal to the terminal end portion in an undrawn position, wherein the distal end portion may comprise a bend linking the proximal end portion to the terminal end portion. The terminal end portion may be configured to move simultaneously distally and laterally in response to drawing of the bow.

The cable guard body may be a single piece. The terminal end portion may extend laterally relative to the proximal end portion. The cable guard body may comprise a rigid member and a pivoting member, with the pivoting member being pivotally attached to a distal end of the rigid member and the terminal end portion of the cable guard body being a terminal end portion of the pivoting member. The terminal end portion may comprise a cable retaining aperture. The terminal end portion may also comprise a cable retaining roller.

In another embodiment, a cable guard support structure may be configured such that a portion of the structure extends longitudinally behind a contact point of the cable against the support structure. The structure may be integrated in one piece and may be configured such that the support for the cable guide may move rearward of the contact point longitudinally and then return toward the riser. In some cases, there may be at least two areas of intersection with a longitudinal plane extending from the guide and cable contact. This may allow greater lateral movement of a cable by allowing longitudinal force to increase lateral movement, as compared to other designs where lateral movement is limited by longitudinal force.

In another embodiment, a cable guard comprises a rigid base portion and a pivoting arm oriented such that it has a vertical pivot axis relative to the bow. The pivot arm may extend forward toward the riser relative to the pivot axis in an undrawn position. A cable guide may be positioned at a proximal end of the pivot arm. In an undrawn or brace position, the pivot arm may be longitudinally forward and laterally furthest away from the arrow flight path of the bow. As the bow is drawn, the position of the cable may move rearward causing the cable guide to move in laterally toward the arrow path and away from the riser. The lateral position of the cable may be determined by the longitudinal position of the cable and the relative location of the pivot axis of the pivot arm.

The above summary of the present invention is not intended to describe each embodiment or every implementation of the present invention. The figures and the detailed description that follow more particularly exemplify preferred embodiments.

DETAILED DESCRIPTION

Figure 1:
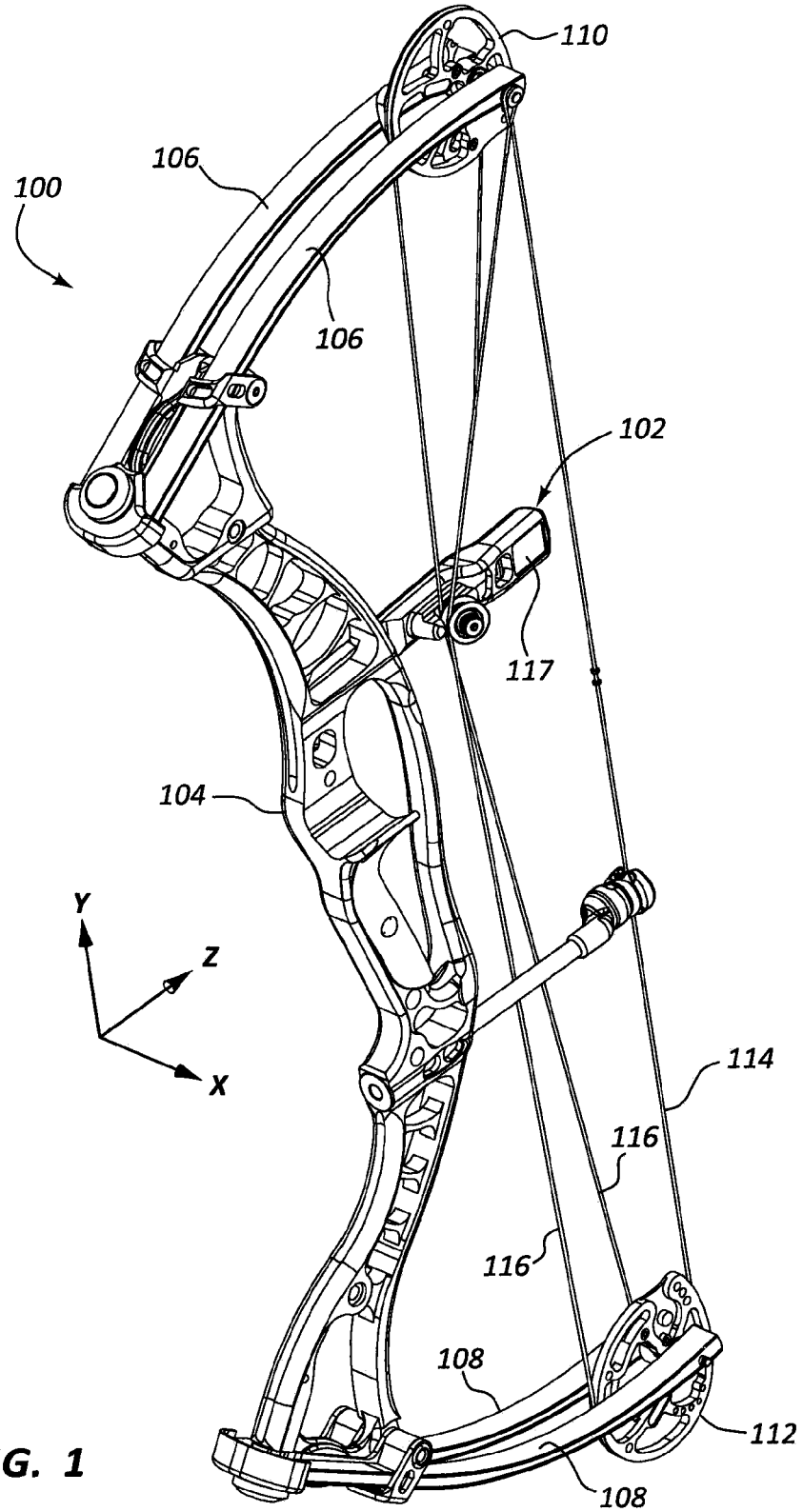
FIG. 1 illustrates a compound bow having a cable guard of the present disclosure.

Many drawbacks of currently available cable guards may be resolved or minimized by the reverse pivot cable guard assembly and related methods of the present disclosure. In some embodiments, a contact, receiving, or retention point for bow cables connected to the reverse cable guard may be configured to move away from the riser as the bow is drawn, thereby reducing tension introduced to the cable by the cable guard. This configuration may also cause the moment induced by the tension on the cable guard to be minimized or reversed in direction when compared to traditional cable guards. The direction of flex of the cable guard may allow cable rollers or other guide features to more closely follow the natural movement of the cables so that side loads are reduced and bearings are more efficient.

According to one embodiment, the reverse flexible cable guard may comprise a substantially rigid cantilever member that is fixed to the riser at a proximal end and extends toward the bowstring to a distal end. A more flexible cantilever member is attached to the rigid member at their distal ends, and the proximal end of the flexible member extends back in a direction toward the riser. The proximal end of the flexible member may comprise rollers or other elements for securing the proximal end to the tensioning cables of the bow. When the bow is drawn, the proximal end of the flexible member is bendable away from the rigid member. This bending draws the proximal end of the flexible member away from the riser, rather than toward the riser, so the contact points between the cable guard and the cables move with the cables away from the riser rather than bending toward the riser. Thus, the cable guard may be referred to as a reversible flexible cable guard since the direction of bending is the reverse of a typical flexible cable guard and the flexible member extends back toward the riser, rather than toward the archer. The moment induced by the bending forces may also be reversed in comparison to traditional cable guards.

The rigidity of the flexible member may be designed to control how much flex is allowed through the draw cycle, so cable rollers may be designed to better retain the cables as the flexible member is bent. A flexible member may be differentiated from a rigid member by the amount of elastic bending that each undergoes throughout the draw cycle, with the flexible member having significantly greater bending than the rigid member. These bending properties may be obtained due to differences in construction materials and/or dimensions of each of the members. For example, a flexible member may be thinner than a rigid member or may comprise a more resiliently bendable material so that the flexible member is less rigid than the rigid member.

In some embodiments, the rollers on the proximal end of the flexible member may be constructed to retain the cables when the bow is undrawn, and may then move as the flexible member bends to support cables through the range of movement of the cables through the draw cycle. In this manner, the side loads applied to the rollers may be reduced, giving the cable guard less noise and inducing less unnecessary tension or wear on the cables. The cable rollers may be held to the flexible member by a mounting block or may be attached directly to the flexible member.

In other embodiments, the cable guard may have a pivoting member attached to the end of the rigid member. The pivoting member may retain the cables of the bow and may pivot when the bow is drawn such that the retention point of the cables is moved away from the riser. The pivot motion may also move the retention point toward the plane of arrow flight, further reducing tension in the cables at full draw. Upon release of the bowstring, the pivoting member may pivot back toward the riser. In these embodiments, the pivoting member may be flexible or rigid.

In yet another embodiment, the cable guard may have a single-piece, continuous cantilever member that comprises a bent shape. Thus, the terminal end portion of the cantilever member may bend back toward the riser and the retention point of the cables may be closer to the riser than the distal tip of the bent shape. In these embodiments, the cantilever member may have flexibility through a portion or all of the shape so that the terminal end portion may bend away from the riser and toward the arrow flight plane upon drawing the bow.

Turning now to the figures in detail, FIG. 1 is a perspective view of a compound bow (i.e., bow 100) having a cable guard 102 according to an embodiment of the present disclosure. The bow 100 comprises a handle riser 104, upper and lower limbs 106, 108, upper and lower pulleys 110, 112 (i.e., cams), a bowstring 114, and cables 116. In some embodiments, stabilizers, dampeners, arrow rests, sights, and other modifications and accessories may be used with the bow 100. The cables 116 are in tension between the pulleys 110, 112 and are held by the cable guard 102 out of the flight path of an arrow launched by the bowstring 114. In some cases, the cable guard 102 may be said to hold the cables 116 out of a plane defined by the bowstring 114 and an arrow or the bowstring 114 and the handle riser 104.

As shown in FIG. 1, as used herein, the X axis may be referred to as a lateral axis or an axis extending in the lateral directions (i.e., to the right and left of the bow 100), the Y axis may be referred to as a vertical axis or an axis extending the vertical directions (i.e., upward and downward relative to the bow 100), and the Z axis may be referred to as a longitudinal axis or an axis extending in the longitudinal directions (i.e., forward and backward relative to the bow 100). In some cases herein, a "longitudinal" direction or axis may refer to a direction or axis running along a length of a body, such as along the length of rigid member 118, even if the longitudinal axis running along the body is not parallel to the Z axis.

Figure 2:
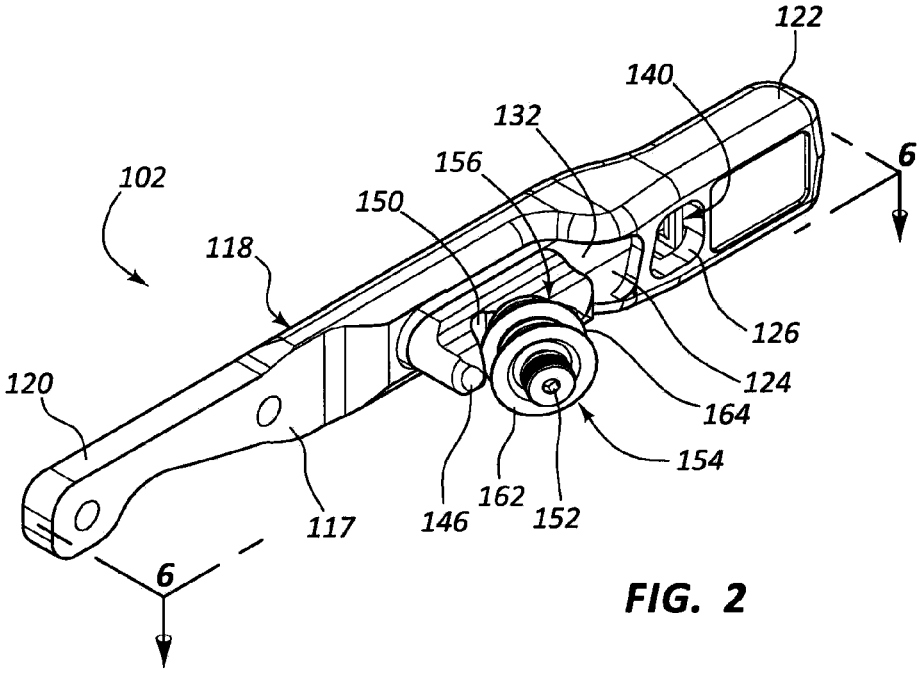
FIG. 2 shows an isometric view of a cable guard of the present disclosure.
Figure 3:
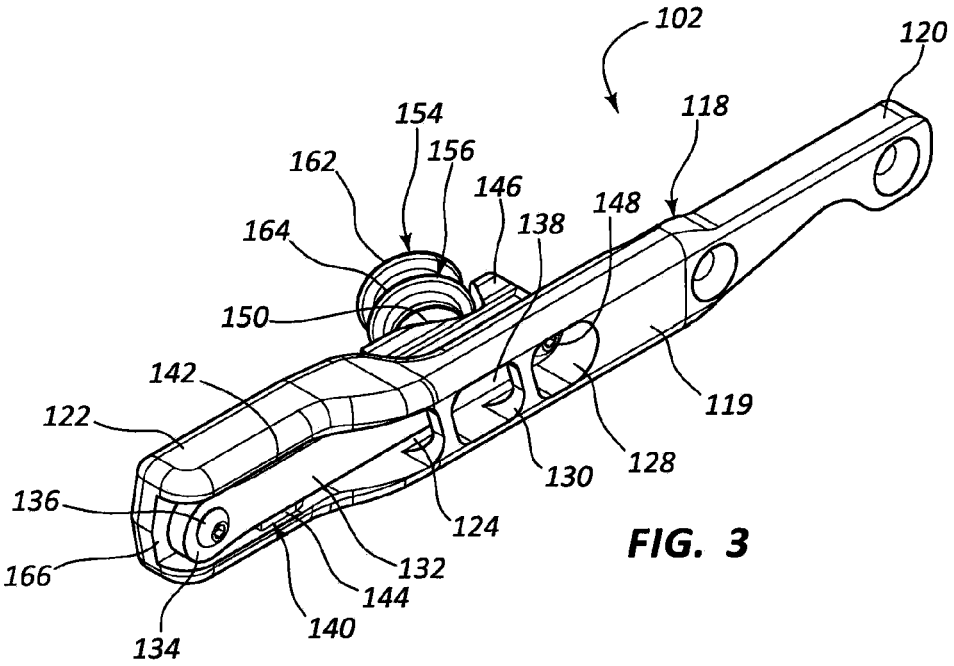
FIG. 3 shows another isometric view of the cable guard of FIG. 2.
Figure 4:
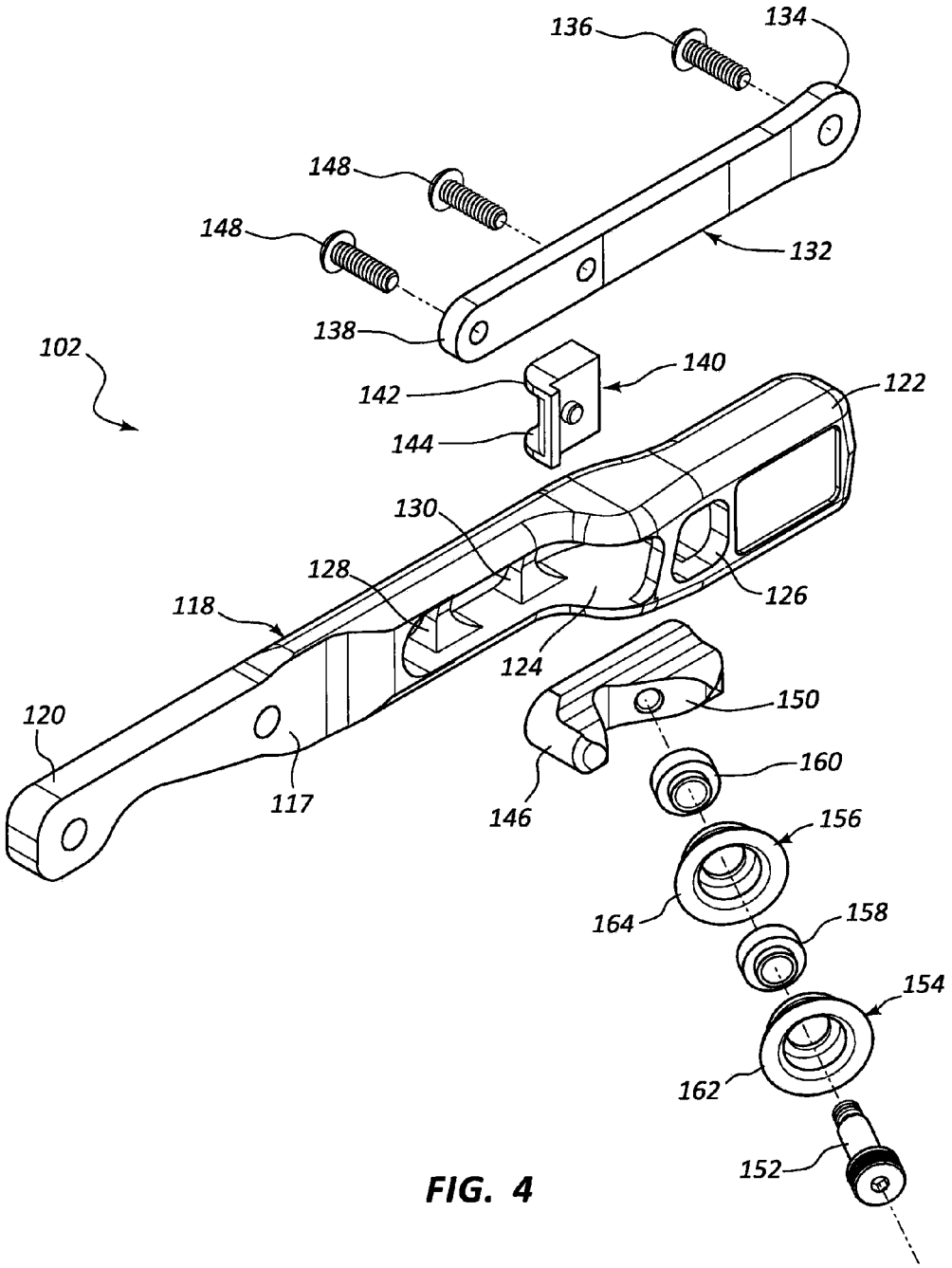
FIG. 4 shows an exploded view of a cable guard of the present disclosure.
Figure 5:
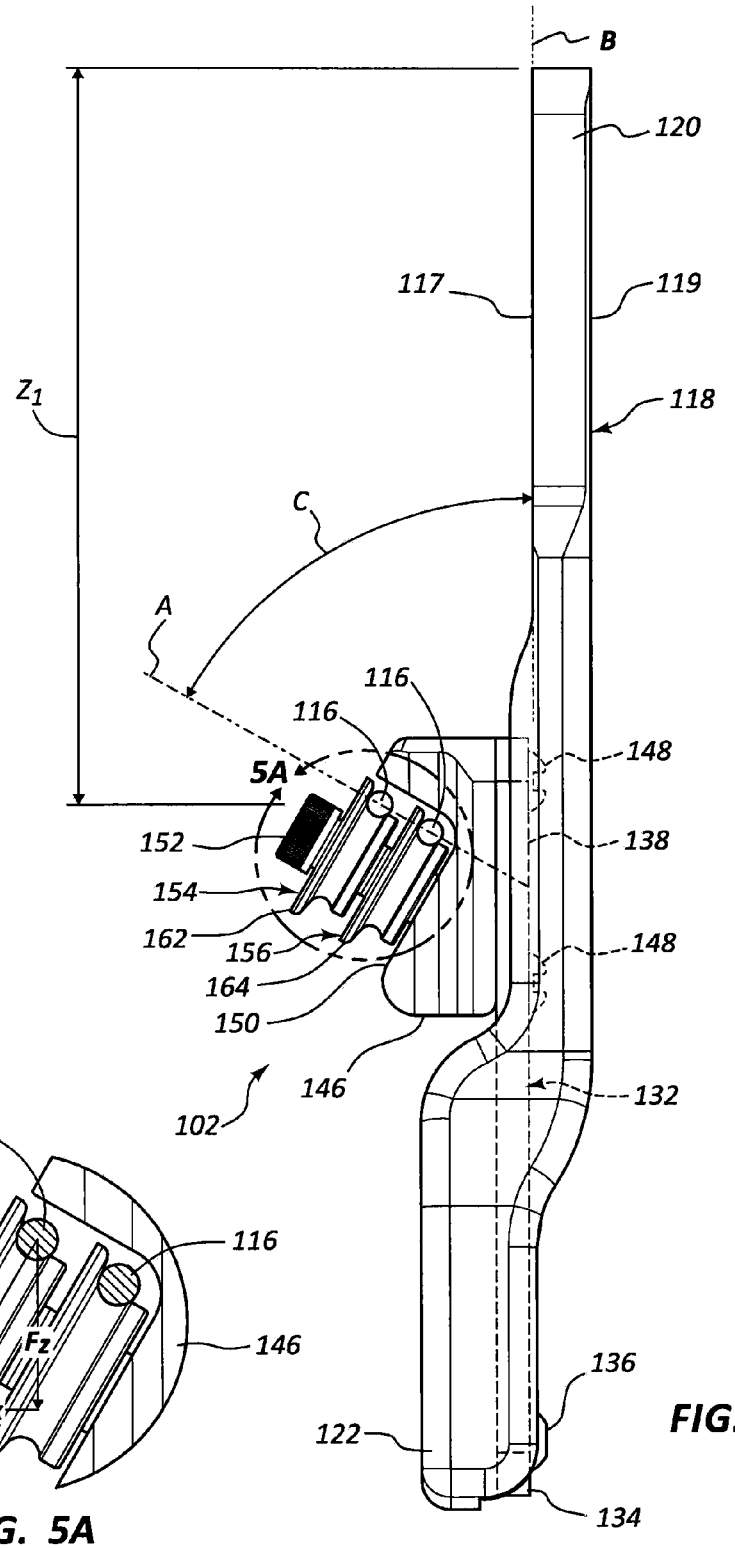
FIG. 5 is a top view of a cable guard of the present disclosure in a rest position.
Figure 6:
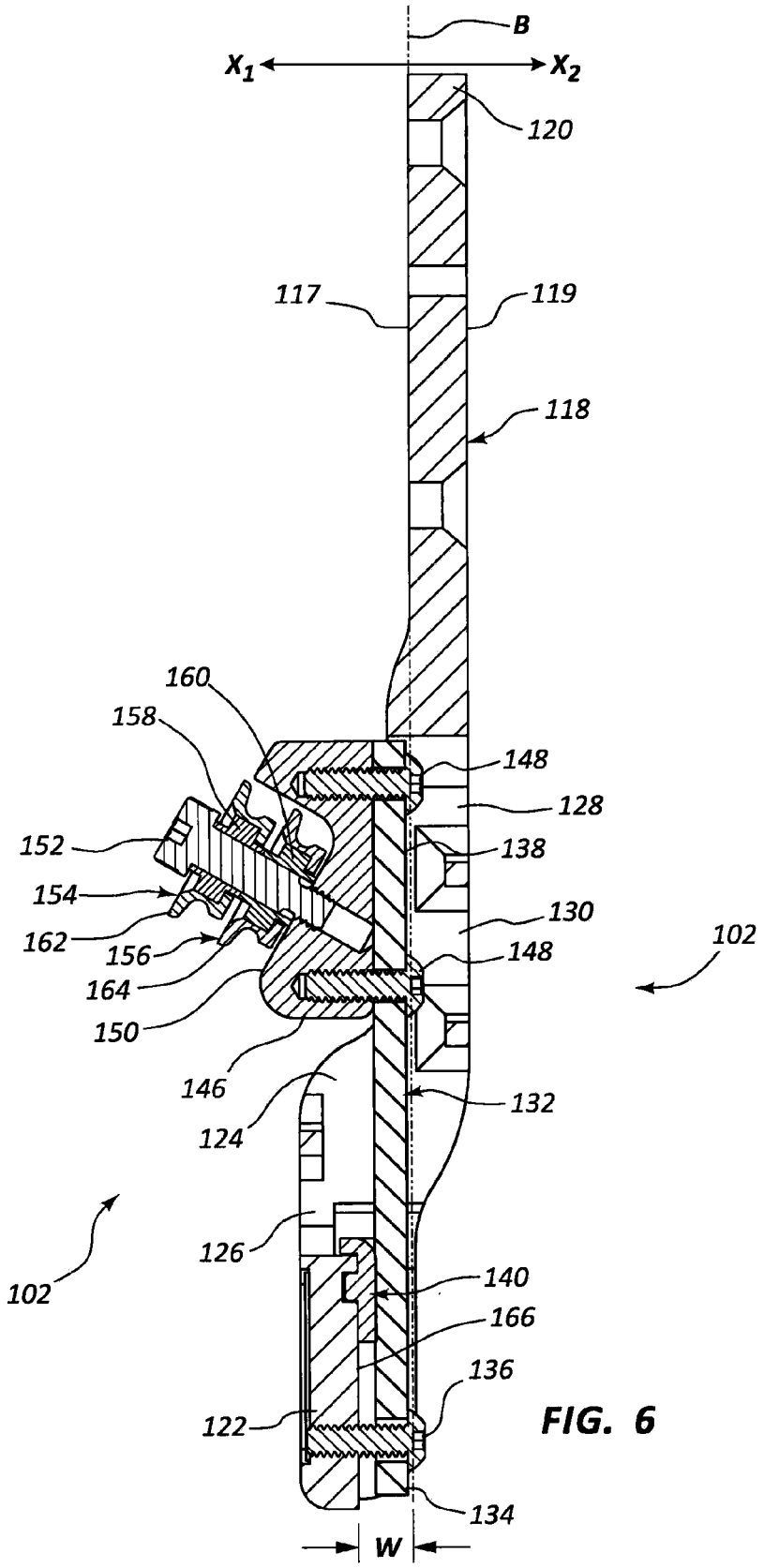
FIG. 6 is a top section view of the cable guard of FIG. 2.

FIGS. 2-5 show views of the cable guard 102 in detail. FIG. 2 is an isometric view showing a cable-facing side 117 of the cable guard 102, FIG. 3 is an isometric view showing an external-facing side 119 of the cable guard 102, FIG. 4 is an exploded view of the cable guard 102, FIG. 5 is a top view of the cable guard 102, and FIG. 6 is a top section view of the cable guard 102 taken through section lines 6-6 in FIG. 2.

The cable guard 102 may comprise a rigid member 118 having a proximal end 120 attached to the handle riser 104 and a distal end 122 extending away from the handle riser 104. With the proximal end 120 of the rigid member 118 firmly attached (or removably attached) to the handle riser 104 and the distal end 122 free from attachment to the riser 104, the rigid member 118 may be referred to as a first cantilever member or a base portion. The distal end 122 may also be referred to as extending toward an archer, the cables 116, or bowstring 114 since it extends rearward from the handle riser 104. In these embodiments, the distal direction may be defined as extending away from the handle riser 104 and the proximal direction may be defined as extending toward the handle riser 104 relative to the rigid member 118.

The proximal end 120 of the rigid member 118 may be connected to the handle riser 104 by connecting means such as, for example, fasteners, adhesives, epoxies, interlocking parts, and combinations of these or related means. In some applications, the cable guard 102 may have a proximal end 120 integrally formed with the handle riser 104. The rigid member 118 may comprise a construction of metal, alloy, and/or composite materials providing rigidity. The rigid member 118 may beneficially be made with light and durable materials such as aluminum to reduce overall bow weight and to improve the lifespan of the cable guard 102 while it is used in the field. The rigid member 118 may also be formed with a plurality of openings 124, 126, 128, 130 that are described in more detail below. See FIGS. 2-3.

The rigid member 118 may be connected at its distal end 122 to a flexible member 132. A distal end 134 of the flexible member 132 may be connected to the distal end 122 of the rigid member 118. This connection may be secured by a fastener (e.g., bolt 136), adhesive, interlocking parts, and/or other related connection means at that connection point. A proximal end 138 of the flexible member 132 may extend proximally from the distal end 134 toward the handle riser 104. The proximal end 138 may be referred to as a "free" end since it is not rigidly connected to the rigid member 118. The flexible member 132 may be referred to as a second cantilever member due to it being securely attached to the distal end 122 of the rigid member 118 and being free from the rigid member 118 at its proximal end 138. The flexible member 132 may also be referred to as a flexible retaining member or a cable mounting arm due to its function in retaining the cables 116.

The flexible member 132 may comprise a flexible yet durable material, such as, for example, metals, alloys, composites, and/or polymers capable of bending under tension applied by the bow cables 116. In some embodiments, the dimensions of the flexible member 132 may be adapted to make the flexible member 132 bendable. For example, the thickness of the flexible member 132 may be reduced in at least some portions of the flexible member 132 in a manner that allows the flexible member 132 to more readily bend at those portions. A central portion of the flexible member 132 between the proximal end 138 and distal end 134 may beneficially be shaped in this manner to provide greater flexibility to the flexible member 132.

The flexible member 132 may be supported by a support member 140 disposed between the flexible member 132 and the rigid member 118. This support member 140 may alternatively be referred to as a rocker or a support guide. The support member 140 may comprise a durable material such as, for example, an elastomeric polymer (e.g., nylon or thermoplastic polyurethane (TPU)) or rubber. The support member 140 may be shaped with upper and lower guides 142, 144 to keep the flexible member 132 properly aligned along a longitudinal axis of the rigid member 118. The support member 140 may be attached to the rigid member 118 and/or to the flexible member 132. When the flexible member 132 flexes under tension from the cables 116, the support member 140 may deform under pressure applied by the flexible member 132 moving and/or bending toward the cable side of the rigid member 118, and the support member 140 may provide a point around which the flexible member 132 bends. See FIG. 7. The support member 140 may also act as a dampener to damp vibrations in the flexible and rigid members 132, 118 when an archer shoots the bow. This may reduce noise, giving the bow a lower noise profile, and may reduce vibrations in the archer's arm after releasing the bowstring 114.

In some embodiments, the flexible member 132 may bend back toward the external-facing side 119 of the cable guard 102, such as when the bowstring is released and the proximal end 138 of the flexible member 132 resiliently bends back toward the external-facing side 119 of the cable guard 102. In these instances, the support member 140 may not restrain that movement due to the support member 140 only being attached to either the rigid member 118 or the flexible member 132 (i.e., not both). In various embodiments, the rigid member 118 may bend toward the cables or away from the cables (or both, in sequence), depending on the rigidity of the rigid member 118 and the flexible member 132. Typically, the rigid member 118 bends toward the cables, but to a lesser extent than the flexible member 132.

The proximal end 138 of the flexible member 132 may be attached to a mounting block 146. The mounting block 146 may be fastened to the flexible member 132 by connectors such as, for example, fasteners 148, adhesives, or interlocking parts. See FIGS. 3 and 6. The mounting block 146 may have an angled surface 150 that may beneficially be perpendicular to an axis A running horizontally through the cables 116. See FIGS. 5 and 7. Said another way, the angled surface 150 may be non-parallel with respect to the cable side 117 of the cable guard 102 or an axis B running along the length of the rigid member 118. Alternatively, axis A may be defined as passing through the axle of rotation (roller axle 152) of the cable rollers 154, 156. Axis B may be defined as running along the length of the rigid member 118 at a surface on which the rigid member 118 is attachable to a riser. Axis B may also be defined as another axis parallel to this surface or a surface on the external-facing side 119 of the cable guard 102. The angle C between axes A and B may beneficially have a size between about 5 degrees and about 45 degrees. In some embodiments, the angle C may be between about 45 degrees and about 90 degrees. Lower angles for angle C may be beneficial in embodiments where the flexible member 132 undergoes a large amount of deflection when the bow 100 is drawn.

Figure 5A:
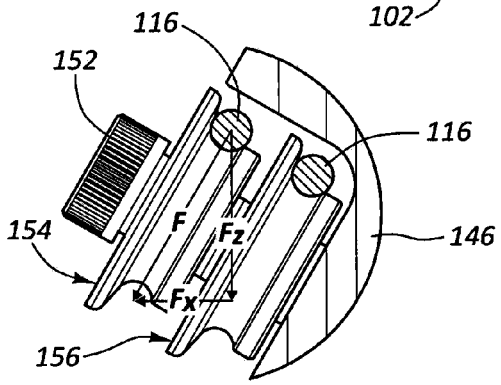
FIG. 5A is a detail view of a guide portion of FIG. 5.

FIG. 5A shows a detail view of the mounting block 146 and the forces acting on the rollers 154, 156 by the cables 116. The force F of a cable 116 may be divided into orthogonal directional components $F_X$ and $F_Z$. $F_Z$ acts in the Z-direction (along axis B of FIG. 5 or axis Z of FIG. 1) and tends to drive the mounting block 146 away from the riser, increasing the length of $Z_1$. $F_X$ acts in the X-direction (perpendicular to axis B in FIG. 5 or along axis X in FIG. 1) and tends to drive the mounting block 146 away from the rigid member 118.

A roller axle 152 may extend from the angled surface 150 generally toward the cable-facing side 117 of the cable guard 102. The roller axle 152 may comprise a threaded bolt that is mountable into or onto the mounting block 146 through the angled surface 150. In some embodiments, the roller axle 152 is a rod affixed to the mounting block 146 extending perpendicular to the angled surface 150.

Two rollers 154, 156 may be positioned coaxially around the roller axle 152, preferably with a roller bearing 158, 160 within or between each roller 154, 156 and the roller axle 152. See FIGS. 4 and 6. The rollers 154, 156 may turn around the roller axle 152 as the cables 116 move through the draw cycle. Because the rollers 154, 156 are at the free end of the flexible member 132, they may turn as the flexible member 132 bends. Thus, the rollers 154, 156 may have widened outer flanges 162, 164 so that the cables 116 do not come unseated from the rollers 154, 156 as the flexible member 132 bends toward and away from the rigid member 118. See FIGS. 5 and 7. As the limbs 106, 108 of the bow 100 flex, they rotate the roller wheels 154, 156 into a more perpendicular orientation relative to the arrow shaft and resulting cable loads, as shown by angle C being closer to 90 degrees in FIG. 7 than in FIG. 5. This may help properly load the roller wheel bearings 158, 160, thus resulting in a more efficient system with less wear on the cables and rollers.

The rollers 154, 156 and roller bearings 158, 160 may be removable from the roller axle 152. The outer roller 154 and inner roller 156 may have the same size and shape, or may have different profiles. For example, in some embodiments, the inner roller 156 may have a smaller outer flange 164 since it does not deflect as far as the outer roller 154 upon bending of the flexible member 132.

The assembly of rollers 154, 156, the roller axle 152, and roller bearings 158, 160 may collectively be referred to as a guide portion of the cable guard 102. The guide portion may guide the movement of the cables 116 and flexible member 132 through the draw cycle of the bow 100.

The rigid member 118 may comprise a central opening 124, a cable-side opening 126, and two external-side openings 128, 130. The cable-side opening 126 and external-side openings 128, 130 may reduce the weight of the rigid member 118. The external-side openings 128, 130 also allow access to the fasteners 148 for the mounting block 146. The central opening 124 may allow the flexible member 132 to extend from the external-facing side 119 of the cable guard 102 to the cable-facing side 117 of the cable guard 102. The central opening 124 may therefore allow the flexible member 132 to be positioned through the rigid member 118. See FIG. 6.

The distal end 134 of the flexible member 132 may also be positioned to be laterally offset from the lateral position of the proximal end 120 of the rigid member 118. As shown in FIG. 6, the attachment surface 166 on which the flexible member 132 is attached may be offset from the cable-facing side 117 surface on which the proximal end 120 of the rigid member 118 is attached. Here, the attachment surface 166 is separated from the cable-facing side 117 by a width W, which extends in the $X_1$ direction from the cable-facing side 117 of the proximal end 120 of the rigid member 118. In some embodiments, the width W may be about as wide as the thickness of the flexible member 132. Width W may also be based on the width of the handle riser 104, so that the neutral position of the distal end 134 of the flexible member 132 is placed at a predetermined position relative to the cables 116 whether the riser 104 is laterally thicker or thinner than shown. Thus, the width W may be customized to a specific handle riser width. In some embodiments, the width W may be less than the thickness of the flexible member 132, such as a width W of zero.

In other arrangements, the width W may extend in the $X_2$ direction (i.e., with the cable-facing side 117 of the distal end 134 of the flexible member 132 positioned in the $X_2$ direction from the cable-facing side 117 of the proximal end 120 of the rigid member 118). This configuration may be beneficial when the flexible member 132 is designed to have a large amount of bending deflection while the bow is undrawn. This design may also be used hold the cables further in the $X_2$ direction from the plane of arrow flight.

FIG. 5 shows an embodiment where the rigid member 118 has an elongated step-like shape when viewed from above that extends from the proximal end 120 to the distal end 122. The shape of the rigid member 118 may take on other forms, such as, for example, a zigzag shape, a right angle, a curve (which may be convex or concave on the cable-facing side 117), or a generally straight line. The shape of the rigid member 118 may have these different shapes to modify the orientation of the flexible member 132 relative to the handle riser 104. In some embodiments, the rigid member 118 may be at least partially flexible as well, and the shape of the rigid member 118 may therefore be shaped to accommodate the flexibility of the rigid member 118 as the bow is drawn.

Figure 7:
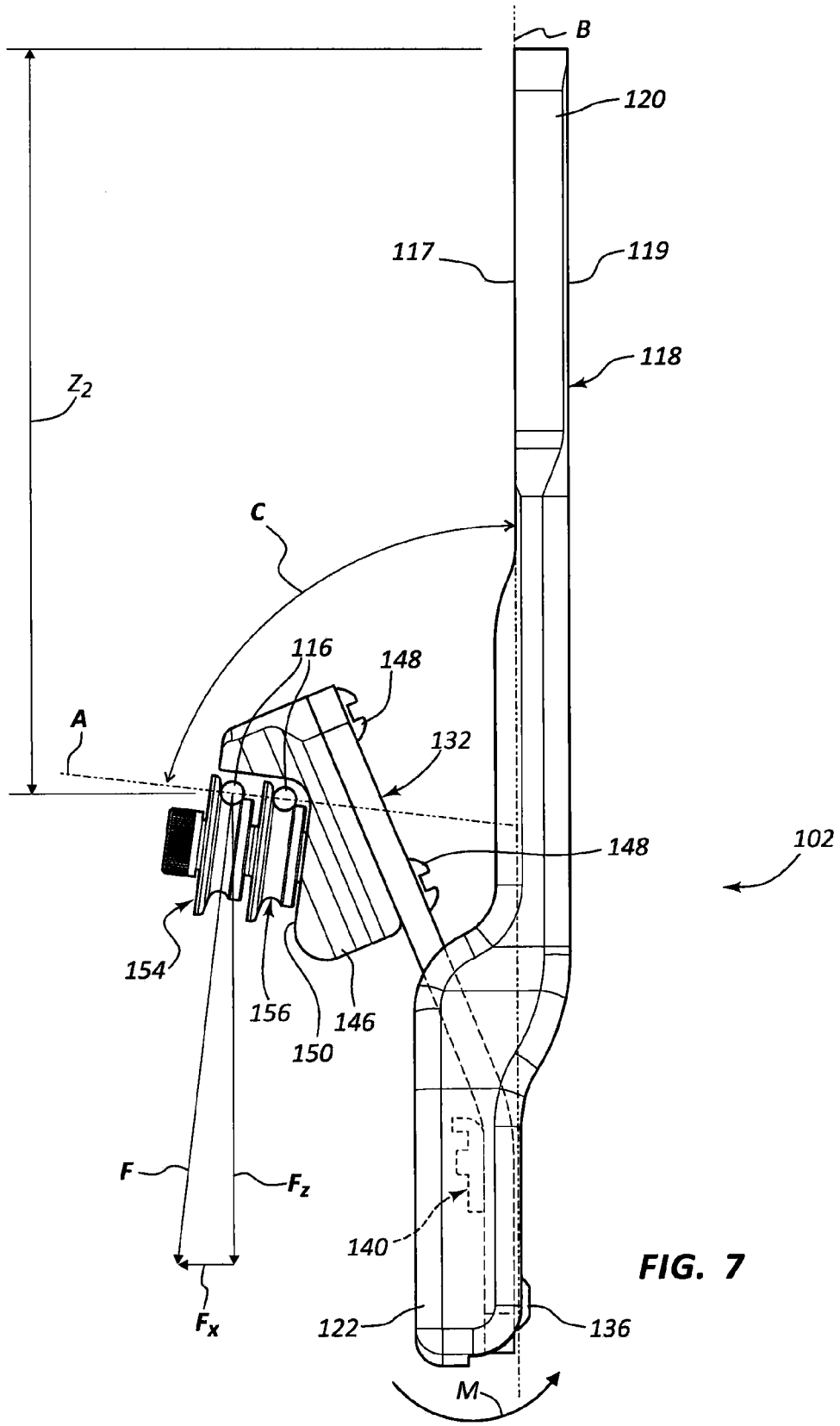
FIG. 7 is a top view of a cable guard of the present disclosure in a flexed position.

As shown in FIG. 7, the flexible member 132 of the cable guard 102 may simultaneously flex partially away from the handle riser and partially toward the arrow. The force F applied by the cable 116 may be broken down into a force $F_Z$ toward the archer and a force $F_X$ toward the plane of the arrow and bowstring 114. The cable 116 moves farther from the riser 104 between the brace height position of FIG. 5 having lateral distance $Z_1$ from the riser and the drawn position of FIG. 7 having lateral distance $Z_2$ from the riser. As compared to the force F in FIG. 5A, $F_X$ may be smaller in FIG. 7 with the bow drawn than in FIG. 5A with the bow undrawn because the cables 116 are brought closer to the arrow plane in the X direction. $F_Z$ may be larger in FIG. 7 than in FIG. 5A because the cables 116 draw the mounting block 146 rearward in the Z direction.

As a result of these forces, the moment generated by the cables 116 on the bow 100 may either be neutral (i.e., canceled out by the bowstring and arrow) or may be in the opposite direction when compared to a conventional flexible cable guard. In the top view of FIG. 7, the moment M at the distal end 122 of the rigid member 118 is counter-clockwise as opposed to what would be a clockwise moment at the distal end of a conventional guard because $F_Z$ is greater than $F_X$ for each cable and the force F is applied laterally relative to the proximal end 138 of the flexible member 132. This may mean the cable guard 102 induces less torque on the bow 100 and tension in the cables 116, so the bow may be easier to tune and may have less cam lean. Additionally, the reversed torque may improve tracking of the string and arrow during the shot. The lessened cam lean during the draw and let down cycle allows the string to track straighter, reducing wear on the strings and cables.

The straighter path of the bowstring 114 may also reduce horizontal and vertical force changes when loading the arrows and may reduce the spine breakdown (i.e., buckling) of the arrow shaft. This can also make spine selection of arrow shafts less critical for proper arrow flight. Archers may have different inputs to the riser grip and string at full draw and during the shot of the bow. Those differences may result in differences in arrow tuning. The cable guard 102 may allow for adjustment of the bowstring 114 and cable 116 positions so that the archer may tune their location for the archer's given input.

A conventional cable guard or roller guard may fix the cables into static positions throughout the draw and shot cycle of the bow. As the bow is drawn, cable tensions may increase to compress the limbs and create torque on the riser, limbs, and cams of the system. This torque may result in excess vibration and noise as all components return to their original positions. By allowing the cables to move inward toward the arrow and rearward toward the archer with a reverse pivot cable guard, the torque in the system may be minimized. The change in cam and limb position and riser twist may be significantly reduced, thus allowing the system to settle faster, reduce shot noise, and improve the feel and overall experience for the archer.

Figure 8A:
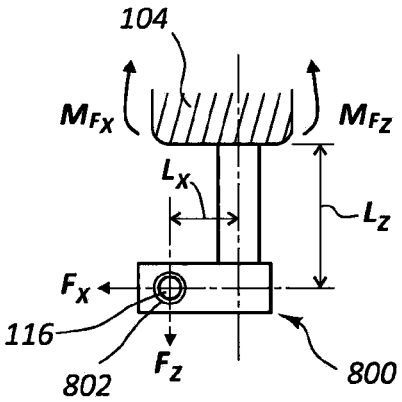
FIG. 8A (Prior Art)
FIG. 8A is a top view of a conventional cable guide in an undrawn position.
Figure 8B:
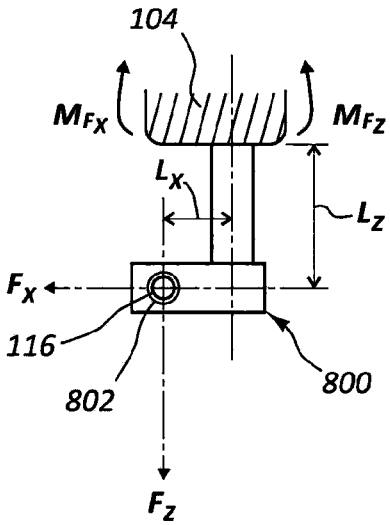
FIG. 8B (Prior Art)
FIG. 8B is a top view of the cable guide of FIG. 8A in a drawn position.

FIGS. 8A-9B illustrate some example conventional cable guards for comparison with embodiments of the present disclosure. FIGS. 8A and 8B illustrate a guard 800 that rigidly fixes a cable 116 relative to a riser 104. In FIG. 8A, an undrawn cable 116 acts on the rigid guide 800 within an aperture 802 or track in the guide 800. This cable tension applies a force having an $F_X$ and an $F_Z$ component as shown. Because the cable 116 is offset from the riser 104 by lengths $L_X$ and $L_Z$, resulting moments $M_{FX}$ and $M_{FZ}$ are applied to the bow. When the bow is drawn, as shown in FIG. 8B, the cable increases in tension due to restraint of its natural tendency to move toward the arrow flight plane and away from the riser. The increased tension in the cable 116 accordingly increases forces $F_X$ and $F_Z$, which in turn increase the moments $M_{FX}$ and $M_{FZ}$. In order to minimize the moments acting on the bow to improve shot consistency, $M_{FX}$ and $M_{FZ}$ should preferably cancel each other as much as possible. One way to do so is to increase $M_{FZ}$ to more closely match $M_{FX}$ by increasing length $L_X$ as the bow is drawn. Increasing $L_X$ also reduces the associated force $F_X$ which reduces the moment $M_{FX}$. However, because the guard 800 is rigid, length $L_X$ undergoes only negligible change between undrawn and drawn bow positions.

Figure 9A:
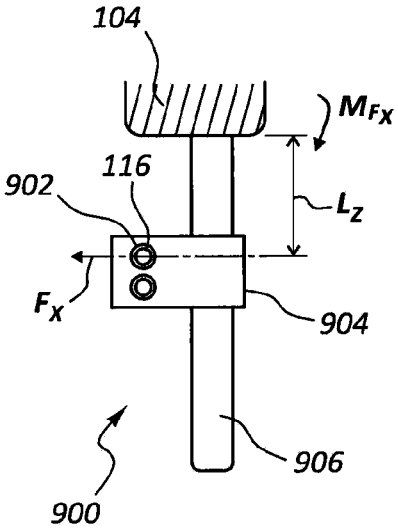
FIG. 9A (Prior Art)
FIG. 9A is a top view of another conventional cable guide in an undrawn position.
Figure 9B:
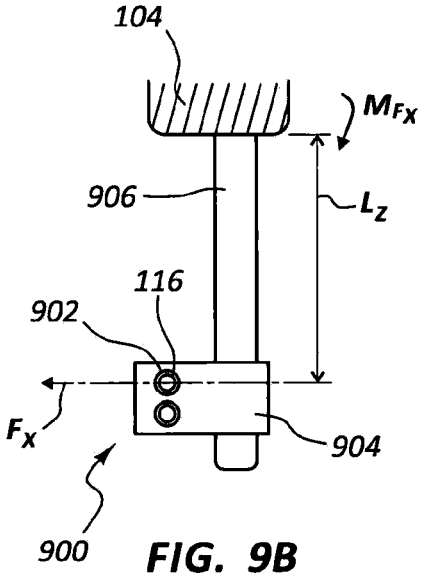
FIG. 9B (Prior Art)
FIG. 9B is a top view of the cable guide of FIG. 9A in a drawn position.

FIGS. 9A-9B show another conventional cable guard 900 for retaining a cable 116 within an aperture 902. The aperture 902 is formed in a slide 904 configured to move longitudinally along a rod 906 connected to the riser 104. A force $F_X$ is applied to the guard 900 by the cable 116 at a distance $L_Z$. The slide 904 may move along the rod 906 between undrawn and drawn positions (i.e., between FIGS. 9A and 9B, respectively), so there is no Z-component of tension causing a force $F_Z$ to be applied in this embodiment. When the bow is drawn, however, the slide 904 does not move in the X direction lateral to the rod 906, so the tension in the cable 116 causes force $F_X$ to increase, and because FX is unopposed, it applies a large moment $M_{FX}$ to the riser 104. Embodiments of the present disclosure have been developed through identifying these issues with conventional cable guards and designing and constructing cable guards that can minimize or cancel undesirable moments applied to the riser and forces applied to the cable guard.

Figure 10:
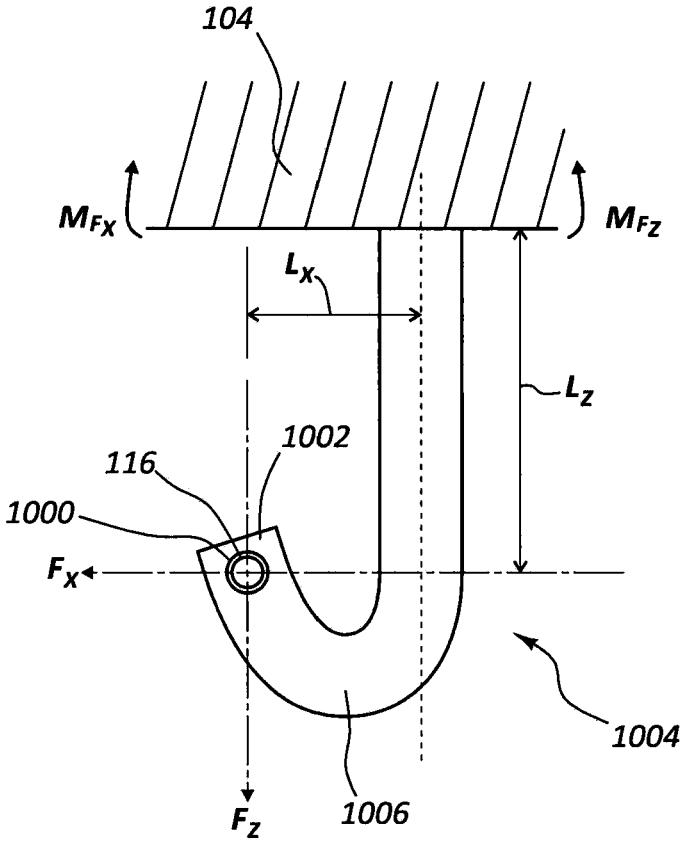
FIG. 10 is a top view of another cable guide of the present disclosure.

FIG. 10 shows an embodiment of the present disclosure that may address some of the undesirable effects of the designs of FIGS. 8A-9B. The cable 116 in this embodiment is secured to a cable guard member 1004 through an aperture 1000 in a terminal end portion 1002 of the cable guard member 1004 attached to the riser 104. The cable guard member 1004 comprises a distal end portion 1006 having a curved shape that extends longitudinally (i.e., distally) from the aperture 1000 and cable 116. Thus, the length $L_Z$ at which the cable 116 is secured is less than the length to the distal end portion 1006 of the cable guard member 1004. Tension in the cable 116 may engage the terminal end portion 1002 with forces $F_X$, $F_Z$, resulting in moments $M_{FX}$ and $M_{FZ}$ applied to the riser 104. When the bow is drawn, the cable guard member 1004 may flex in the direction of the tension applied and increase the lengths $L_X$ and $L_Z$. As a result, moments $M_{FX}$ and $M_{FZ}$ may be minimized as compared to a rigid guard (e.g., the guard 800 of FIG. 8A). Because the bend in the distal end portion 1006 is positioned longitudinally beyond the aperture 1000, the member 1004 lengthens in both the X and Z directions to reduce torque.

In some embodiments, the cable guard member 1004 may comprise a flexible material configured to resiliently flex as the cable 116 is drawn. Beneficially, the flexible material may be rigid enough to retain the cable 116 away from the arrow plane to a desired distance at least while the bow is undrawn. In some embodiments, portions of the cable guard member 1004 may be more rigid than others. For example, the distal end 1006 may be more flexible than proximal portions of the cable guard member 1004.

While a hook or "J" shape is shown in FIG. 10, in some embodiments, the shape of the cable guard member 1004 may be a "V" shape, "U" shape, "N" shape, or other bent form. When referring to a "bent" shape, the cable guard member 1004 may be constructed by bending a material or may be formed in a shape that resembles a material that has been bent. Constructing the material without actually bending the guard member 1004 may potentially be beneficial to reduce residual stresses in the material. The cable guard member 1004 may further be configured to retain multiple cables 116 instead of only one. In some cases, a roller or set of rollers may be positioned at the terminal end portion 1002, such as in the manner of the embodiment of FIGS. 1-7 having a mounting block.

Figure 11A:
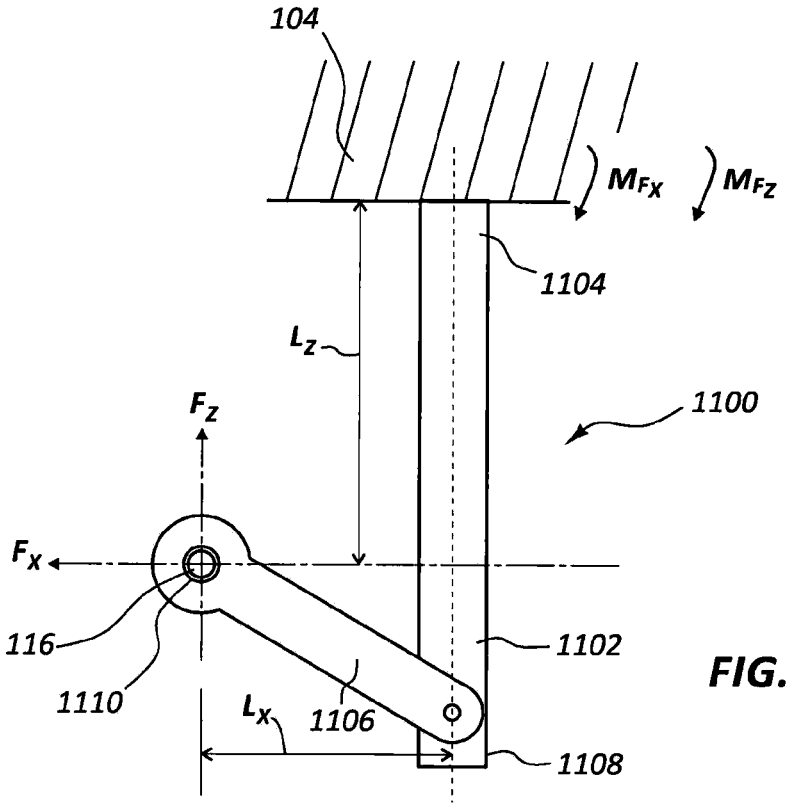
FIG. 11A is a top view of another cable guide of the present disclosure in an undrawn position.
Figure 11B:
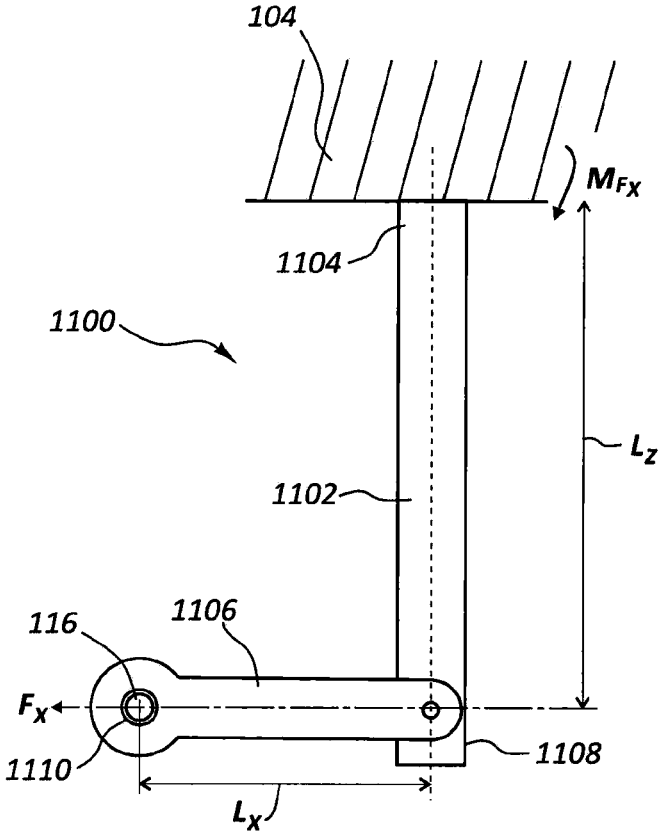
FIG. 11B is a top view of the cable guide of FIG. 11A in a drawn position.

Yet another embodiment is shown in FIGS. 11A-11B. The cable guard 1100 in these figures comprises a rigid member 1102 attached to the riser 104 at a proximal end 1104. A pivoting member 1106 is pivotally secured to the rigid member 1102 at a distal end 1108 of the rigid member 1102. The pivoting member 1106 is preferably positioned so that in an undrawn position, as shown in FIG. 11A, the cable 116 extending through the aperture 1110 in the pivoting member 1106 is spaced proximally relative to the distal end 1108 of the rigid member 1102. As the bow is drawn, the tension in the cable 116 may rotate the pivoting member 1106 relative to the rigid member 1102, thereby increasing the length $L_Z$ to the cable 116. The increase in $L_Z$ may beneficially decrease the force $F_Z$ applied by the cable 116. In some embodiments, the rotation of the pivoting member 1106 may also be configured to increase length $L_X$ at full draw, thereby reducing force component $F_X$. Using these configurations, moment $M_{FZ}$ may be eliminated at full draw and moment $M_{FX}$ may be reduced as compared to conventional guards. In some cases, a roller or set of rollers may be positioned at the terminal end portion 1002, such as in the manner of the embodiment of FIGS. 1-7 which use a mounting block. The included angle between the rigid member 1102 and the pivoting member 1106 at an undrawn position may be less than 90 degrees. At a drawn position, the included angle may be beneficially 90 degrees or less.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A compound archery bow having a cable guard, the bow comprising:

a handle riser assembly including a riser, upper and lower limbs each including a limb proximal end connected to the riser and a limb distal end, and a pulley positioned at the limb distal end of each of the upper and lower limbs;

at least one cable and a bowstring extending between the pulleys;

a cable guard comprising:

a first cantilever member having a first cantilever member proximal end connected to the riser and a first cantilever member distal end;

a second cantilever member having a second cantilever member distal end securely fixed to the first cantilever member distal end and a second cantilever member proximal end extending toward the handle riser, the second cantilever member being configured to flex or bend upon drawing the bowstring;

a guide portion attached to the second cantilever member proximal end, the guide portion receiving at least one portion of the at least one cable.

2. The compound archery bow of claim 1, wherein the guide portion comprises at least one roller wheel, the at least one roller wheel configured to contact and roll along the at least one cable.

3. The compound archery bow of claim 2, wherein a roller axis extends through a center of rotation of the at least one roller wheel and a longitudinal axis extends along a length of the first cantilever member and an included angle between the roller axis and the longitudinal axis increases when the bowstring is drawn.

4. The compound archery bow of claim 1, wherein the first cantilever member comprises an opening, the second cantilever member being positioned through the opening.

5. The compound archery bow of claim 1, wherein the second cantilever member is attached to a side of the first cantilever member opposite a direction of deflection of the second cantilever member upon drawing the bowstring.

6. The compound archery bow of claim 1, wherein the second cantilever member proximal end is configured to deflect away from the handle riser upon drawing the bow.

7. The compound archery bow of claim 1, the first cantilever member further comprising a support guide contacting the second cantilever member between the second cantilever member proximal end and the second cantilever member distal end.

8. A flexible guide cable guard for an archery bow, the cable guard comprising:

a base portion configured to mount to a riser of an archery bow;

a cantilevered flexible retaining member securely fixed to the base portion and having a free end extending toward the riser, the free end having at least one cable retaining guide configured to receive a cable of a bow, the free end being configured to deflect away from the riser upon bending relative to the base portion.

9. The flexible guide cable guard of claim 8, wherein the at least one cable retaining guide comprises an aperture.

10. The flexible guide cable guard of claim 8, wherein the at least one cable retaining guide comprises a roller.

11. The flexible guide cable guard of claim 8, wherein the at least one cable retaining guide comprises at least two cable retaining rollers.

12. The flexible guide cable guard of claim 11, wherein the at least two cable retaining rollers are coaxial.

13. The flexible guide cable guard of claim 8, wherein the flexible retaining member comprises a shaft extending through the at least one cable retaining guide.

14. The flexible guide cable guard of claim 8, wherein the flexible retaining member is removably attached to the base portion.

15. The flexible guide cable guard of claim 8, further comprising an elastic dampening member positioned between the base portion and the flexible retaining member.

16. The flexible guide cable guard of claim 8, wherein the flexible retaining member extends through an opening in the base portion.

17. A reverse-biased cable guard for an archery bow, the cable guard comprising;

a base portion having a proximal end configured to mount to a riser of an archery bow and a distal end extending away from the riser toward a cable of the archery bow;

a cantilevered cable mounting arm securely fixed to the base portion, the cable mounting arm having at least one cable guide configured to retain the cable of the archery bow;

wherein upon drawing the archery bow, the at least one cable guide contacts the cable of the archery bow, the cable mounting arm flexes or bends, and the distal end of the base portion is subject to a moment tending to bias the distal end of the base portion away from the cable contacting the at least one cable guide.

18. The reverse-biased cable guard of claim 17, wherein upon drawing the archery bow, the at least one cable guide is configured to move in a direction of cable loading on the at least one cable guide.

19. The reverse-biased cable guard of claim 17, wherein the cable mounting arm is more elastically flexible than the base portion.

20. The reverse-biased cable guard of claim 17, wherein upon drawing the archery bow, the cable mounting arm is subject to an opposing moment tending to oppose the moment tending to bias the distal end of the base portion.

21. The reverse-biased cable guard of claim 20, wherein the opposing moment neutralizes the moment tending to bias the distal end of the base portion.

22. A cable guard for an archery bow, comprising:

a cable guard body configured to attach to a handle riser of the archery bow at a proximal end portion and configured to secure a cable of the archery bow at a terminal end portion, the cable guard body having a distal end portion extending distal to the terminal end portion in an undrawn position, the distal end portion comprising a bend or curve in the cable guard body between the proximal and terminal end portions;

wherein the cable guard body comprises a single continuous piece;

wherein the terminal end portion extends away from the distal end portion toward the proximal end portion;

wherein the terminal end portion is configured to move distally and laterally in response to drawing the bow.

23. The cable guard of claim 22, wherein the terminal end portion extends laterally relative to the proximal end portion.

24. The cable guard of claim 22, wherein the terminal end portion comprises a cable retaining aperture.

25. The cable guard of claim 22, wherein the terminal end portion comprises a cable retaining roller.

* * * * *